US011427366B2

(12) United States Patent
Wolf

(10) Patent No.: US 11,427,366 B2
(45) Date of Patent: Aug. 30, 2022

(54) CORE FOR WRAP DISPENSER AND METHOD OF ITS USE

(71) Applicant: Malpack Corp., Charlotte, NC (US)

(72) Inventor: Troy Wolf, Green Bay, WI (US)

(73) Assignee: Malpack Corp., Charlotte, NC (US)

( * ) Notice: Subject to any disclaimer, the term of this patent is extended or adjusted under 35 U.S.C. 154(b) by 136 days.

(21) Appl. No.: 16/529,939

(22) Filed: Aug. 2, 2019

(65) Prior Publication Data

US 2020/0039675 A1 Feb. 6, 2020

Related U.S. Application Data

(60) Provisional application No. 62/713,770, filed on Aug. 2, 2018.

(51) Int. Cl.

| | |
|---|---|
| ***B65B 67/08*** | (2006.01) |
| ***B65H 35/00*** | (2006.01) |
| ***B65H 16/00*** | (2006.01) |

(52) U.S. Cl.

CPC ..... *B65B 67/085* (2013.01); *B65H 16/005* (2013.01); *B65H 35/002* (2013.01); *B65H 2801/81* (2013.01)

(58) Field of Classification Search

None

See application file for complete search history.

(56) References Cited

U.S. PATENT DOCUMENTS

| | | | | | |
|---|---|---|---|---|---|
| 1,118,860 | A * | 11/1914 | Howarth | 242/599.4 | |
| 1,671,724 | A * | 5/1928 | Johancen | B65H 75/08 | 242/599.2 |
| 4,166,589 | A * | 9/1979 | Hoover | B65B 67/085 | 156/577 |
| 5,779,179 | A * | 7/1998 | Zentmyer | B65B 67/085 | 242/423.2 |
| 6,920,742 | B1 * | 7/2005 | Yu Chen | B65B 67/085 | 156/574 |
| 7,228,677 | B2 * | 6/2007 | Yu Chen | B65B 67/085 | 242/570 |
| 8,317,124 | B2 * | 11/2012 | Yu Chen | B65H 16/005 | 242/599.1 |
| 10,472,115 | B2 * | 11/2019 | Clarke | B65B 67/085 | |
| 10,479,632 | B1 * | 11/2019 | Yu Chen | B65B 41/16 | |
| 10,479,635 | B1 * | 11/2019 | Yu Chen | B65H 23/1825 | |
| 10,994,884 | B2 * | 5/2021 | Voo | B65H 16/005 | |

(Continued)

*Primary Examiner* — William A. Rivera

(74) *Attorney, Agent, or Firm* — Blake E. Vande Garde; Avek IP, LLC

(57) ABSTRACT

A film roll compatible with a wrap dispenser comprising a core with a first end with a notch, a second end with a notch, an outer surface and a lumen, a stretch film wrapped around the core, a wrap dispenser comprising a first frame member and a second frame member, a handle connecting the first frame member to the second frame member, a first roller operationally associated with a second roller with each being connected to the first frame member and the second frame member, an upper boss secured to the first frame member with one or more lugs emanating out of the upper boss, a boss handle operationally associated with the upper boss allowing for the raising and lowering of the upper boss, and a lower boss secured to the second frame member with one or more lugs emanating out of the lower boss.

16 Claims, 10 Drawing Sheets

(56) References Cited

U.S. PATENT DOCUMENTS

| | | | | |
|---|---|---|---|---|
| 2003/0208994 | A1* | 11/2003 | Gooding | B65B 67/085 53/390 |
| 2011/0233321 | A1* | 9/2011 | Yu Chen | B65H 16/005 242/588.2 |
| 2012/0031045 | A1* | 2/2012 | Castro Rodriguez | B65B 67/085 53/389.3 |
| 2015/0353215 | A1* | 12/2015 | Yu Chen | B65H 16/005 53/203 |
| 2016/0340070 | A1* | 11/2016 | Yu Chen | B65H 16/005 |
| 2020/0108967 | A1* | 4/2020 | Voo | B65B 67/085 |

* cited by examiner

CORE FOR WRAP DISPENSER AND METHOD OF ITS USE

CROSS REFERENCE TO RELATED APPLICATION

This application claims the priority of the provisional application Ser. No. 62/713,770 filed Aug. 2, 2018. Applicant hereby incorporates by reference the entire content of provisional application Ser. No. 62/713,770.

FIELD OF INVENTION

The present invention related to devices and technology used to secure goods on pallets with stretch wrap and more specifically to devices which dispense stretch wrap and the rolls of stretch wrap used by those devices.

BACKGROUND OF THE INVENTION

In shipping containerized goods, the general practice is to stack a plurality of the containers on a pallet and to utilize material handling equipment such as fork trucks to load and unload the palletized containers. To prevent containers from shifting or from falling from the palletized load, it is generally required to band or wrap the palletized load. Metal or plastic straps or bands in conjunction with clips or buckles have been used for many years for this purpose. Today, it is common to use plastic stretch film to wrap and secure a palletized load of containers. This prevents the goods from shifting or falling during transport and delivery. The stretched film produces a tight wrap on the load and offers some protection against the elements. Shippers can choose between fully automated systems or manually operated systems to dispense stretch film around goods.

One issue that users of manually operated systems face is compatibility between a wrap dispensing device and the rolls of stretch film dispensed from the device. The rolls of stretch film must be the appropriate length, have an appropriate circumference, and have a core which allows for the roll to be secured within the device. When loaded, the rolls must also be stable to efficiently wrap desired goods while also maintaining a defined amount of tension to neither overstretch the stretch film, resulting in a failure of the stretch film, nor under-stretch the film, resulting in a waste of stretch film.

Thus, there remains a current need for a hand-held stretch film wrapping device which permits precise tension adjustments and precise, efficient loading and unloading of stretch film rolls to facilitate a user's ability to safely and swiftly and secure palletized goods.

SUMMARY

A film roll compatible with a wrap dispenser comprising a core with a first end with a notch, a second end with a notch, an outer surface and a lumen, a stretch film wrapped around the core, a wrap dispenser comprising a first frame member and a second frame member, a handle connecting the first frame member to the second frame member, a first roller operationally associated with a second roller with each being connected to the first frame member and the second frame member, an upper boss secured to the first frame member with one or more lugs emanating out of the upper boss, a boss handle operationally associated with the upper boss allowing for the raising and lowering of the upper boss, and a lower boss secured to the second frame member with one or more lugs emanating out of the lower boss, wherein the upper boss and lug are designed to engage with the first end of the core of the film roll by inserting the lug into the notch and wherein the lower boss and lug are designed to engage with the second end of the core of the film roll by inserting the lug into the notch.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
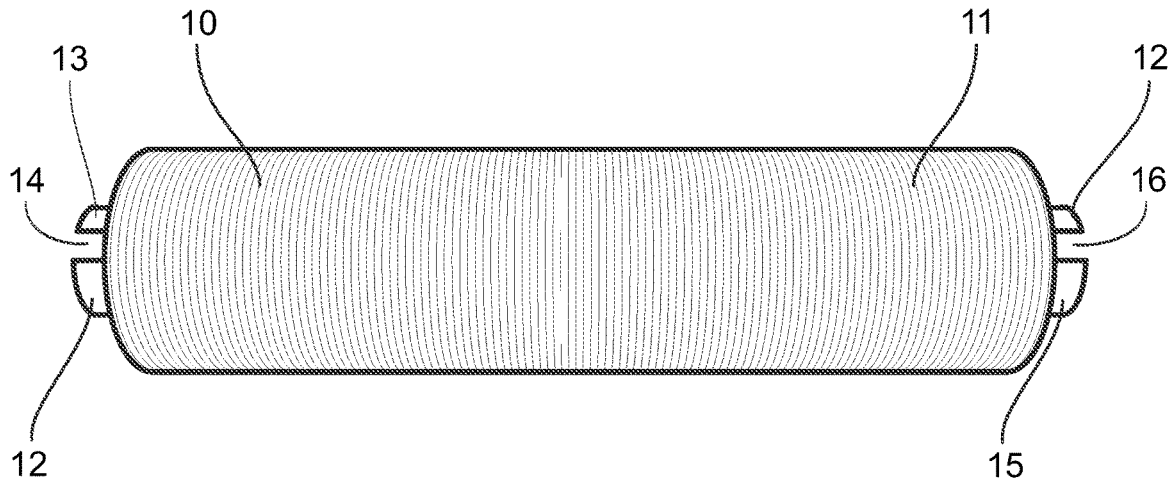
FIG. 1 is a top view of a film roll.
Figure 2:
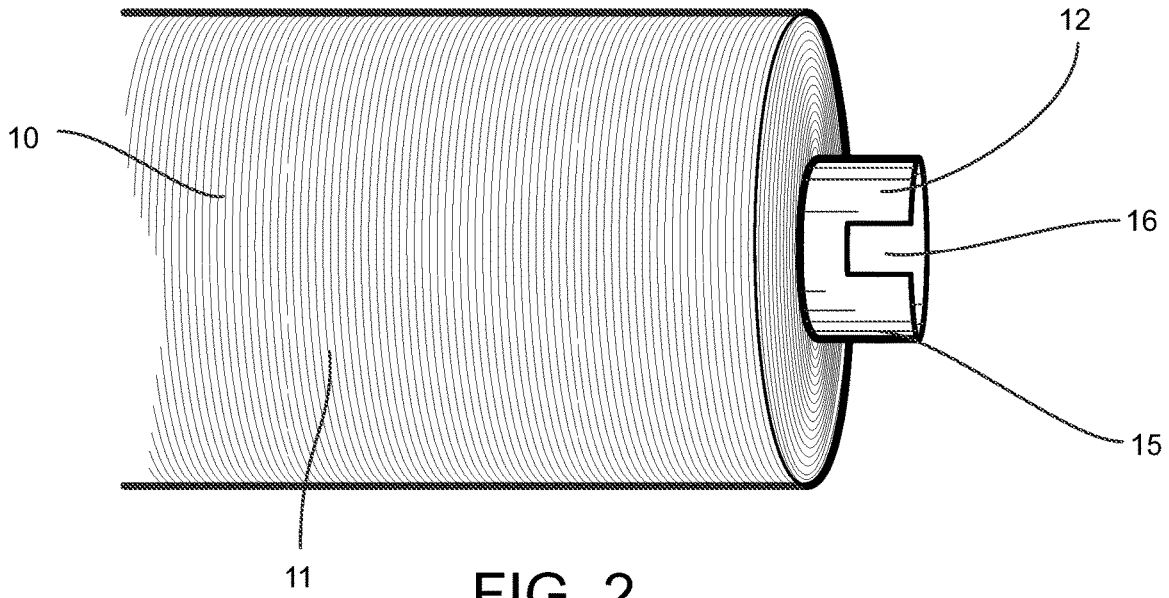
FIG. 2 is a top view of one end of a film roll.
Figure 3:
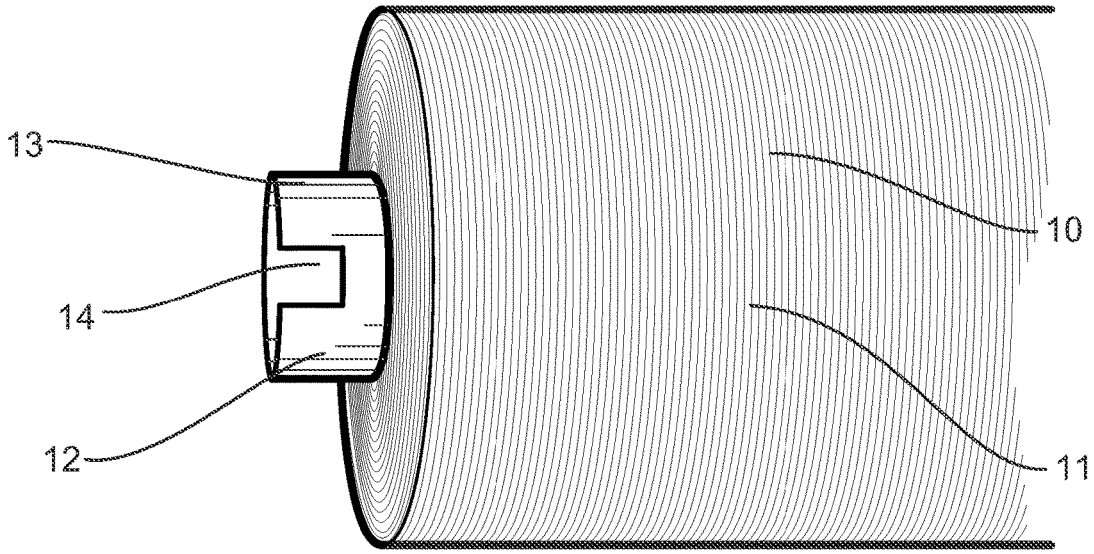
FIG. 3 is a top view of one end of a film roll.
Figure 4:
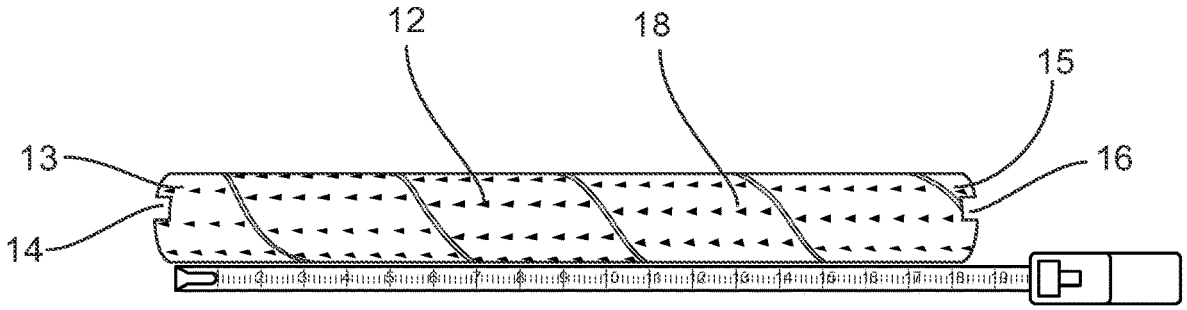
FIG. 4 is a top view of a film roll core.
Figure 5:
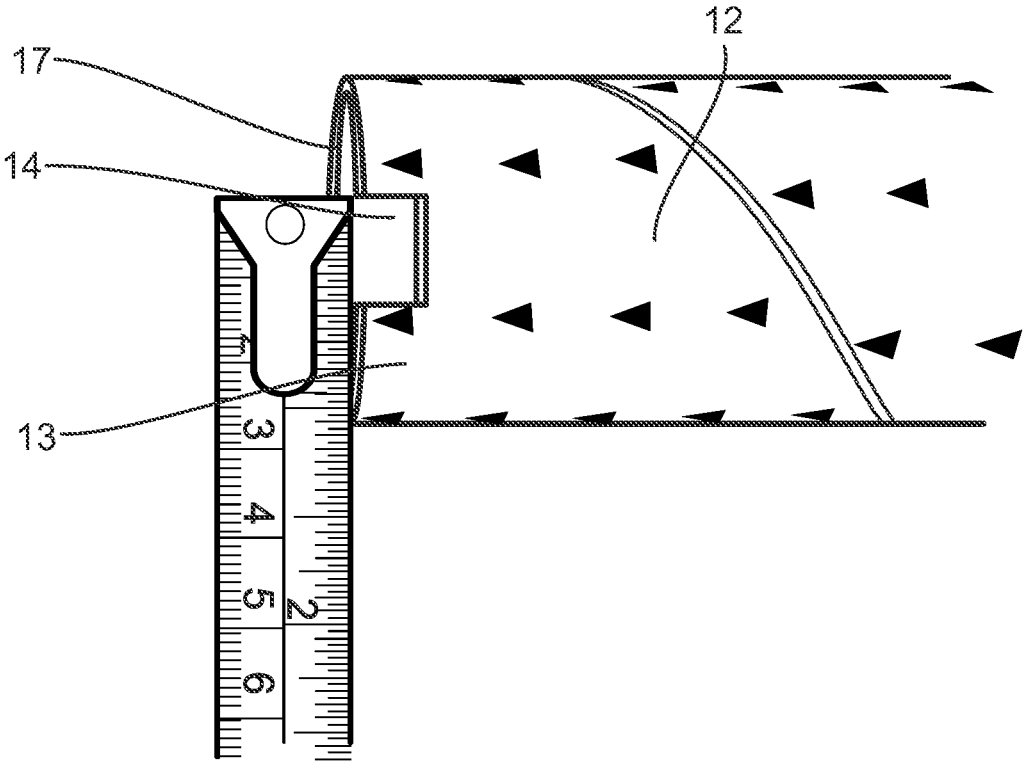
FIG. 5 is a top view of one end of a film roll core.
Figure 6:
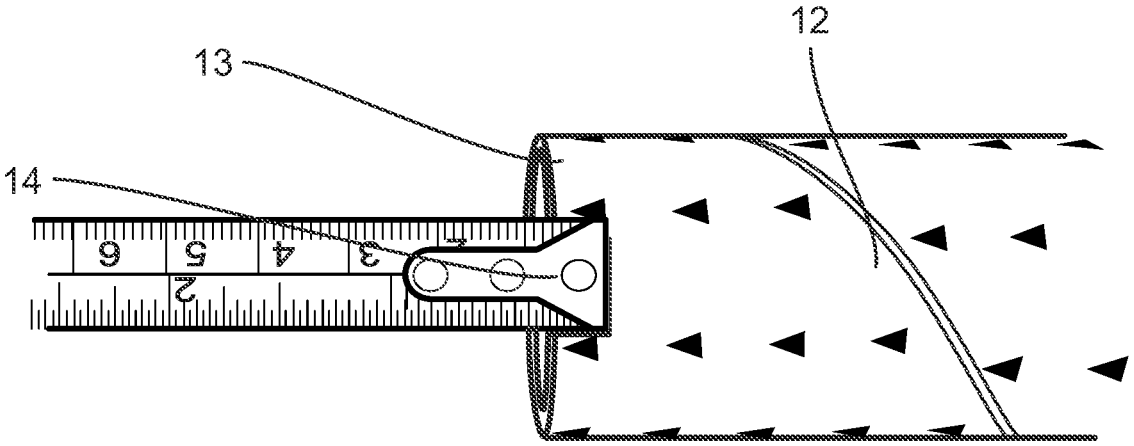
FIG. 6 is a top view of one end of a film roll core.
Figure 7:
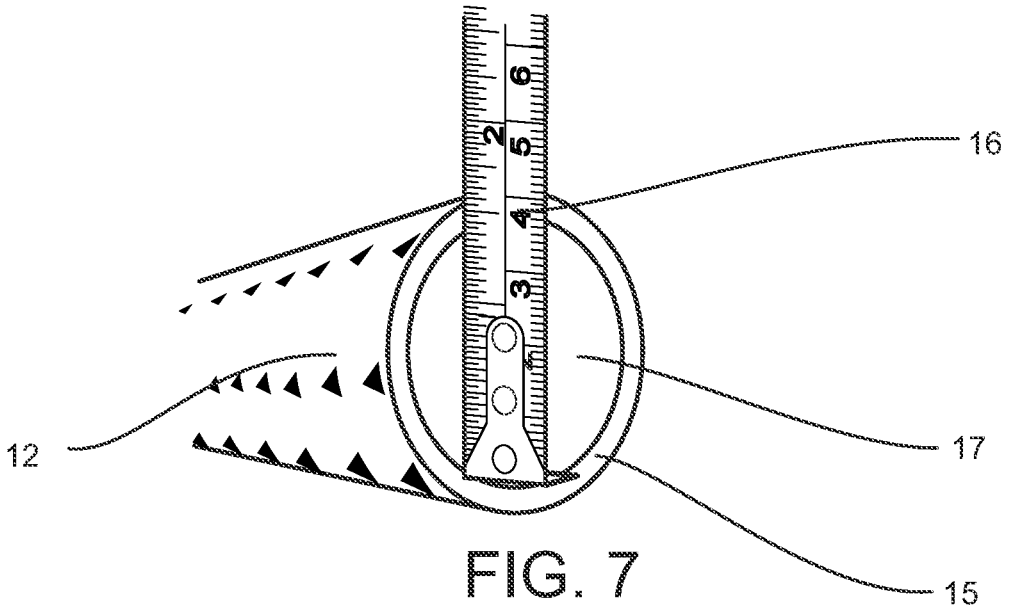
FIG. 7 is a proximal view of one end of a film roll core.
Figure 8:
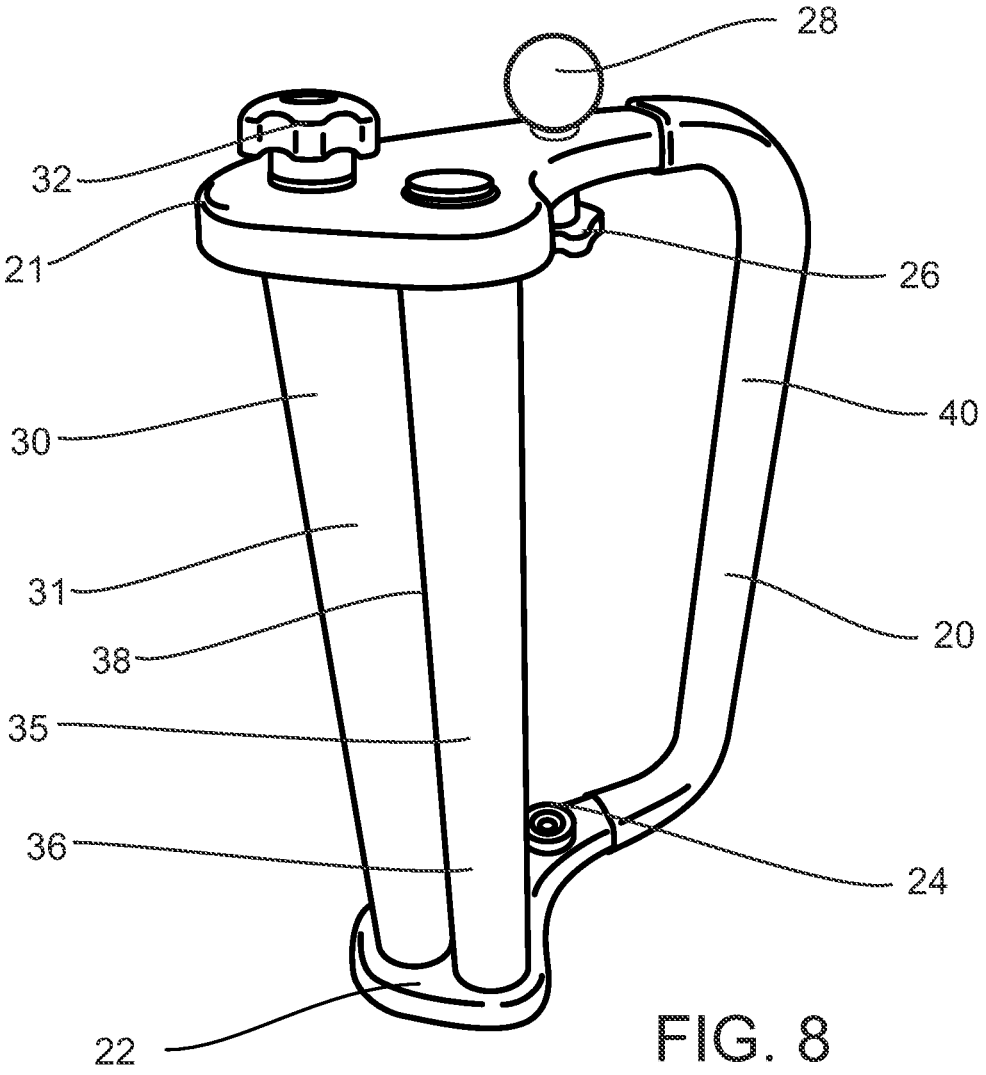
FIG. 8 is a proximal view of a dispenser.
Figure 9:
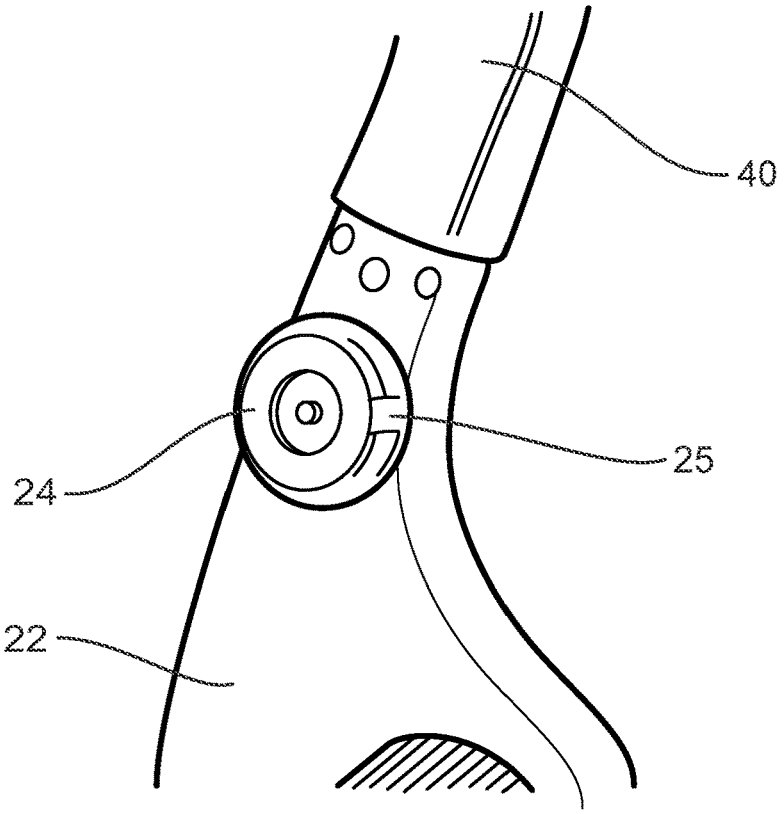
FIG. 9 is a top view of a frame member and lower boss of a dispenser.
Figure 10:
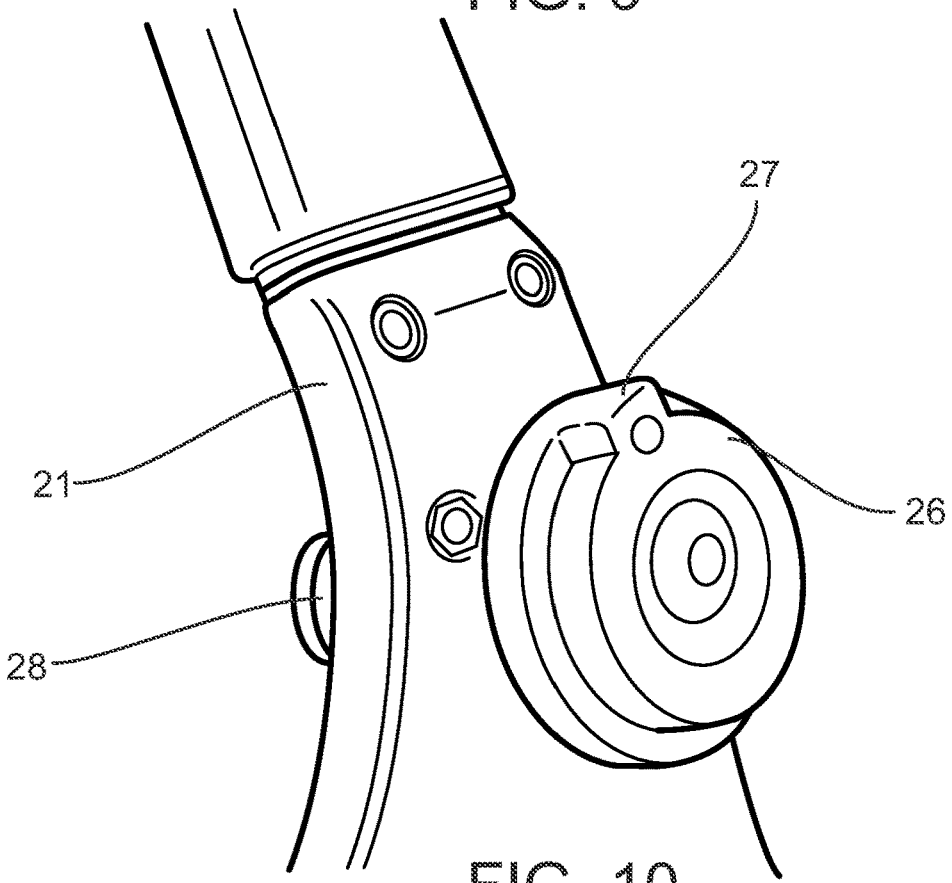
FIG. 10 is a view of a frame member and upper boss of a dispenser.
Figure 11:
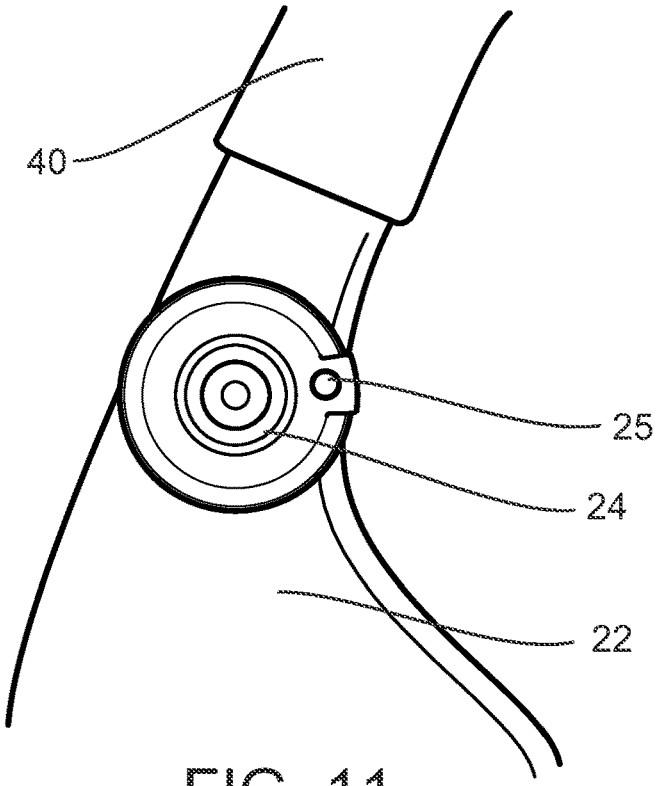
FIG. 11 is a top view of a frame member and lower boss of a dispenser.
Figure 12:
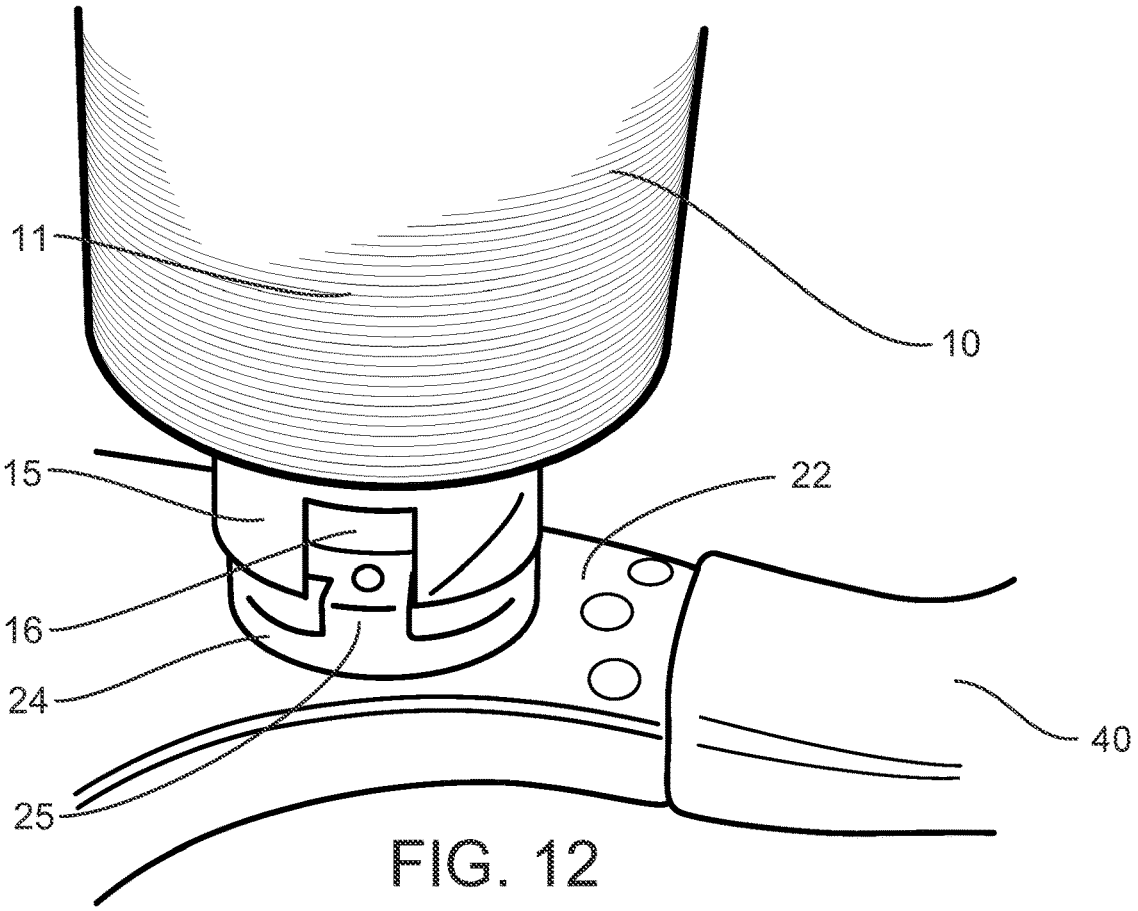
FIG. 12 is a side proximal view of a film roll engaging a lower boss of a dispenser.
Figure 13:
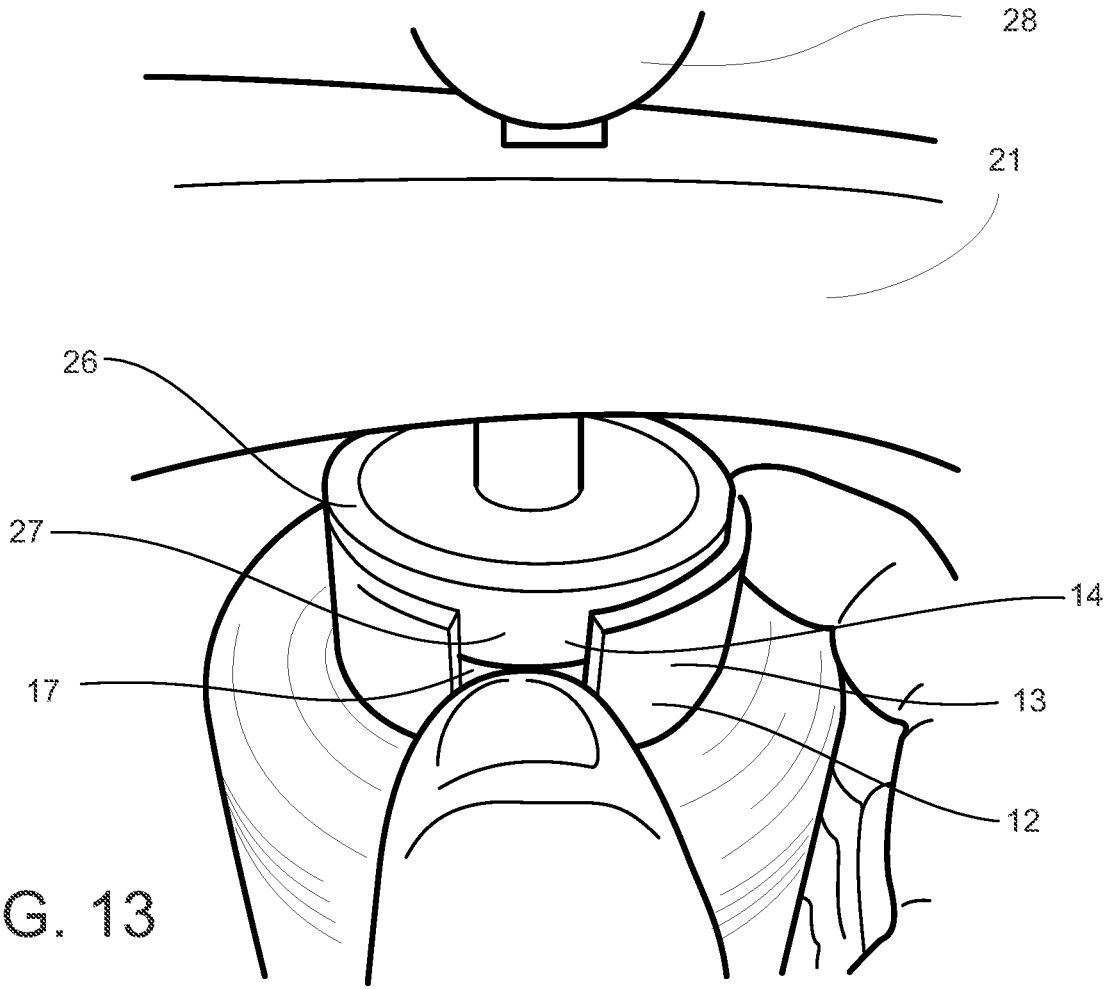
FIG. 13 is a side proximal view of a film roll engaging an upper boss of a dispenser.
Figure 14:
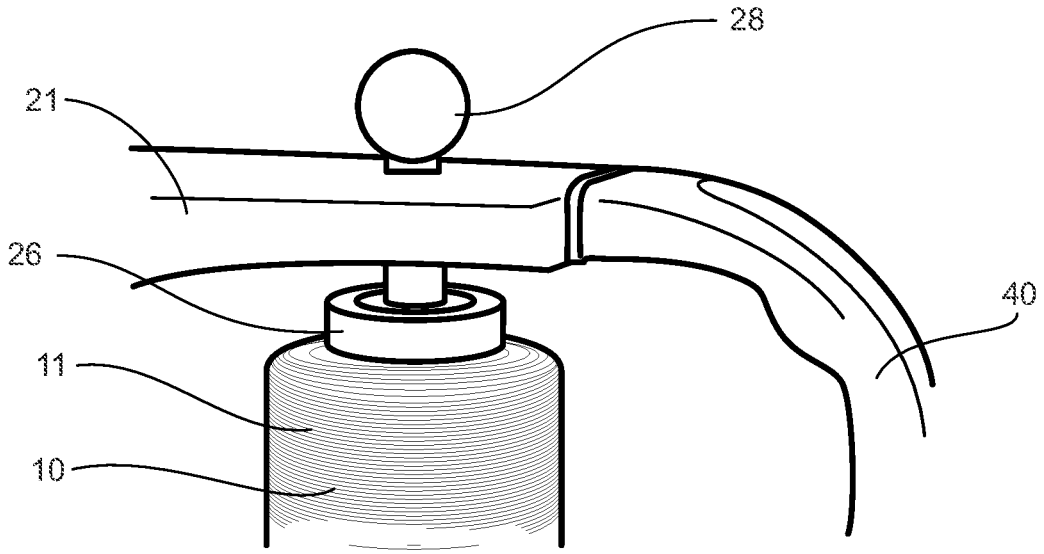
FIG. 14 is a side proximal view of a film roll engaging an upper boss of a dispenser.
Figure 15:
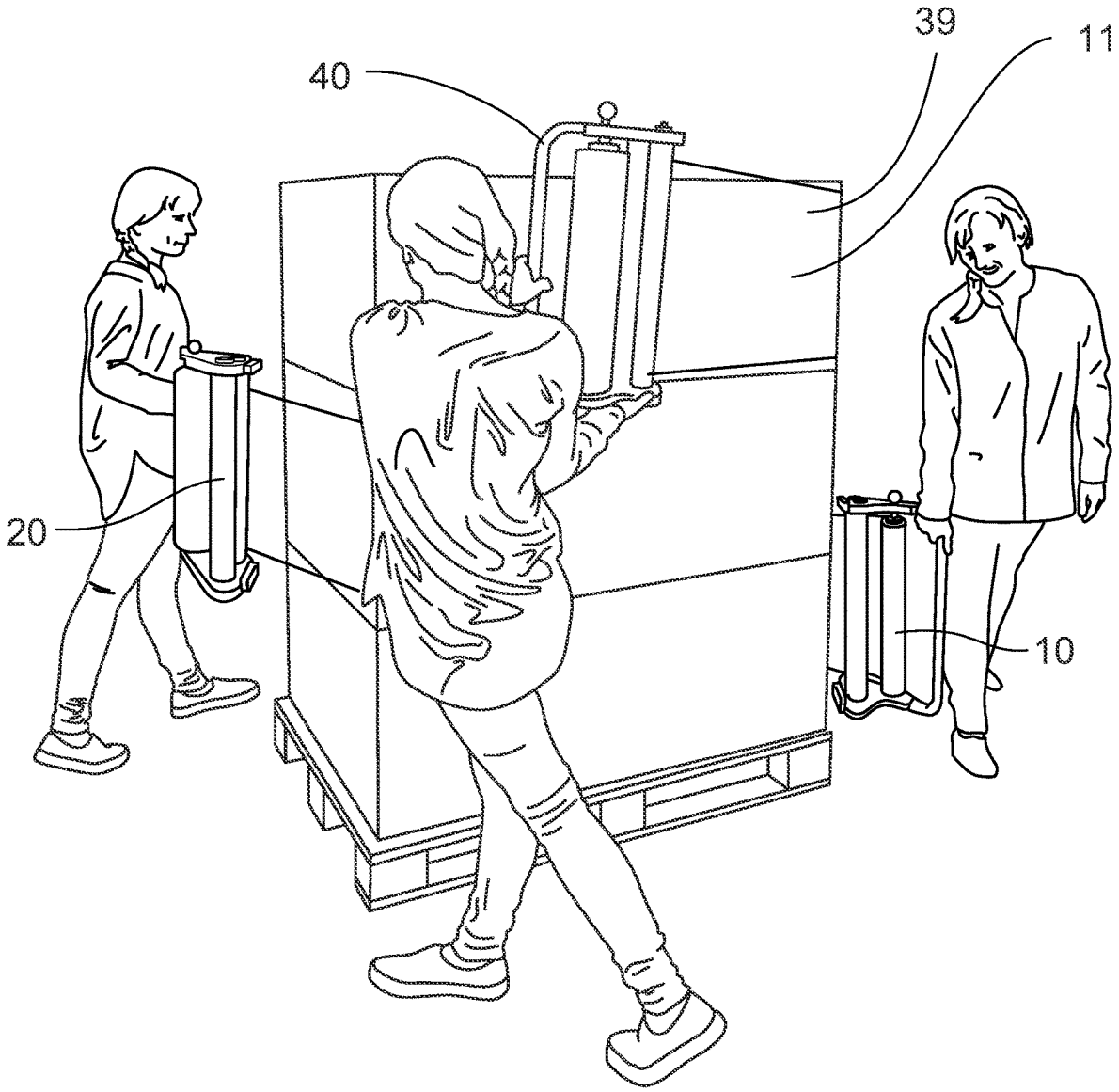
FIG. 15 is a side proximal view of a person wrapping goods on a pallet using a dispenser loaded with a film roll.

Looking to the figures where like numbers indicate like items, FIG. 1 discloses a film roll 10 that is compatible with a wrap dispenser 20 comprising a core 12 which is a hollow tube with a first end 13, a second end 15, an outer surface 18 and a lumen 17. The first end 13 has a notch 14 (see FIG. 3) and the second end 15 has a notch 16 (see FIG. 2). A stretch film 11 is wrapped around the outer surface 18 of the core 12. The core 12 is comprised of metal, plastic, paper, cardstock, or a combination thereof. The core may be substantially solid, a hollow tube, or a combination thereof. The notches 14, 16 have a shape selected from the group including, square, rectangular, circular, triangular, star, or a combination thereof.

In another embodiment of the instant invention, there is a film roll 10 that is compatible with a wrap dispenser 20 comprising a core 12 with a first end 13, a second end 15, an outer surface 18 and a lumen 17. The first end 13 has a notch 14 and the second end 15 has a notch 16. A stretch film 11 is wrapped around the outer surface 18 of the core 12. The embodiment also includes a wrap dispenser 20 comprising a first frame member 21, a second frame member 22 and a handle 40 connecting the first frame member 21 to the second frame member 22. A first roller 30 is connected to the first frame member 21 and the second frame member 22 and a second roller 35 is connected to the first frame member 21 and the second frame member 22 and is operationally associated with the first roller 30. The first roller 30 and/or second roller 35 may be mounted on a rod 56 which is engaged to the first frame member 21 and the second frame member 22. An upper boss 26 is secured to the first frame member 21 with one or more lugs 27 emanating out of the upper boss 26 and a boss handle 28 is operationally associated with the upper boss 26 and passing through the first frame member 21, the boss handle 28 allowing for the raising and lowering of the upper boss 26. A lower boss 24 is secured to the second frame member 22 with one or more lugs 25 emanating out of the lower boss 24. The upper boss 26 and lug 27 are designed to engage with the first end 13 of the core 12 of the film roll 10 by inserting the lug 27 into the notch 14 located on the first end 13 and the lower boss 24 and lug 25 are designed to engage with the second end 15 of the core 12 of the film roll 10 by inserting the lug 25 into the notch located on the second end 15. In the above embodiment, the upper boss 26 or the lower boss 24 may have one or more lugs emanating out, designed to engage one or more notches on an end of the core 12. The lower boss 24 and the upper boss 26 are engaged to the first frame member 21 and the second frame member 22 respectively and each are able to rotate freely to dispense the stretch film 11 from the film roll 10. Each of the rollers can include a rubber-like coating and/or texturing to ensure frictional grip of the stretch film. The stretch film is brought into tractive frictional contact with each of the rollers 30, 35.

The first roller 30 and second roller 35 can include pre-stretch gears 50 operationally associated with the first roller 30 and the second roller 35 which pre-stretches the stretch film 11 as it is dispensed from the wrap dispenser 20. The first pre-stretch gear is operationally associated with the first roller 30 and the second pre-stretch gear is operationally associated with the second roller 35 and the first pre-stretch gear and the second pre-stretch gear are fitted to be in tractive contact with one another so as to produce a transmission ratio so as to differentiate the circumferential velocities of the first and second pre-stretching rollers. The gears are generally different sizes. The stretch film 11 threads past the two rollers in which the rotational speed of the second roller 35 is faster than the first roller 30, thus stretching the stretch film between the two. The pre-stretch gears 50 pre-stretch the stretch film at an amount between 10% and 45%, 15% and 40%, 20% and 40%, 25% and 35%, 20% and 30%, 25% and 30%. The pre-stretch percentage is achieved by using a ratio equivalent to the desired pre-stretch percentage. The tension adjustment handle 32 is used to adjust the gears 50 accordingly. The pre-stretch gears minimize overstretching of the stretch film and also minimized understretching of the stretch film resulting in waste. The film roll and wrap dispenser are designed for single hand use with little to no bending or stretching required by the user. The design allows for stretch film to be dispensed simply by walking forward around the goods that are being wrapped. This reduces back stress during use. The core 12 of the film roll includes colored ends indicating the proper engagement point for the lower boss 24 and upper boss 26 as well as arrows on the outer surface 18 pointing up.

The instant invention also includes a film roll 10 that is compatible with a wrap dispenser 20 comprising a core 12 with a first end 13, a second end 15, an outer surface and a lumen 17. The first end 13 has a notch 14 and the second end 15 has a notch 16. A stretch film 11 is wrapped around the outer surface of the core 12. The embodiment also includes a wrap dispenser 20 comprising a first frame member 21 which includes a lower first frame member 21*a* and an upper first frame member 21*b* which are secured to one another, a second frame member 22 which includes a lower second frame member 22*a* and an upper second frame member 22*b* which are secured to one another, and a handle 40 connecting the first frame member 21 to the second frame member 22. A first roller 30 is connected to the first frame member 21 and the second frame member 22 and a second roller 35 is connected to the first frame member 21 and the second frame member 22 and is operationally associated with the first roller 30. The first roller 30 and/or second roller 35 may be mounted on a rod 56 which is engaged to the first frame member 21 and the second frame member 22. An upper boss 26 is secured to the first frame member 21 with one or more lugs 27 emanating out of the upper boss 26 and a boss handle 28 is operationally associated with the upper boss 26 and passing through the first frame member 21, the boss handle 28 allowing for the raising and lowering of the upper boss 26. A lower boss 24 is secured to the second frame member 22. The upper boss 26 and lug 27 are designed to engage with the first end 13 of the core 12 of the film roll 10 by inserting the lug 27 into the notch 14 located on the first end 13 and the lower boss 24 is designed to engage with the second end 15 of the core 12 of the film roll 10 by inserting the lower boss 24 into the second end 15. In the above embodiment, either the upper boss 26 or the lower boss 24 may have one or more lugs emanating out, designed to engage one or more notches on an end of the core 12. The first roller 30 and second roller 35 can include pre-stretch gears 50 operationally associated with the first roller 30 and the second roller 35 which pre-stretches the stretch film 11 as it is dispensed from the wrap dispenser 20. The pre-stretch gears 50 pre-stretch the stretch film at an amount between 10% and 45%, 15% and 40%, 20% and 40%, 25% and 35%, 20% and 30%, 25% and 30%.

The wrap dispenser 20 is manually operated using either one hand, two hands, or a combination of both. The core 12 is comprised of metal, plastic, paper, cardstock, or a combination thereof. The core may be substantially solid, a hollow tube, or a combination thereof. The notches 14, 16 have a shape selected from the group including, square, rectangular, circular, triangular, star, or a combination thereof. The first roller 30 can further include a tension adjustment handle 32 which allows a user to adjust the amount of tension applied to the stretch film 11 as it passes between the first roller 30 and the second roller 35 of the wrap dispenser 20. Put differently, the first roller 30 further includes a tension adjustment handle 32 which allows a user to adjust the amount of tension applied to the stretch film 11 as it passes around the outer surface 36 of the first roller 30, between the first roller 30 and the second roller 35, and around the second roller 35 of the wrap dispenser 20 as shown in the Figures.

In some embodiments, a portion or all of the upper boss 26 and lower boss 24 are inserted within the core 12 of the film roll when loaded into the wrap dispenser 20. The boss handle 28 operationally associated with the upper boss 26 and passing through the first frame member 21 is spring loaded to compress and secure a film roll 10 between the upper boss 26 and lower boss 24.

Embodiments of the instant invention include a film roll 10 that is compatible with a wrap dispenser 20 comprising a core 12 which is a hollow tube with a first end 13, a second end 15, an outer surface 18 and a lumen 17, the first end having a notch 14 and the second end having a notch 16, and a stretch film 11 wrapped around the outer surface 18 of the core 12. The film roll of this embodiment is designed to be compatible with a wrap dispenser 20 that is automated or is manually operated provided the wrap dispenser 20 includes an upper boss 26 with a lug 27 and a lower boss 24 with a lug 25 which are compatible with the core 12 and the notches 14, 16 on the core to fit snugly within each end 13, 15 of the core. The core 12 is a hollow tube comprised of metal, plastic, paper, cardstock, or a combination thereof. The notches 14, 16 have a shape selected from the group including, square, rectangular, circular, triangular, star, or a combination thereof.

Embodiments of the instant invention include a film roll 10 that is compatible with a wrap dispenser 20 comprising a core 12 with a first end 13, a second end 15 an outer surface 18 and a lumen 17, the first end 13 having a notch 14 and the second end 15 having a notch 16, and a stretch film 11 is wrapped around the outer surface 18 of the core 12. The embodiments include a wrap dispenser 20 comprising a first frame member 21 and a second frame member 22, a handle 40 connecting the first frame member 21 to the second frame member 22, a first roller 30 connected to the first frame member 21 and the second frame member 22 and a second roller 35 connected to the first frame member 21 and the second frame member 22 and is operationally associated with the first roller creating a gap 38 between the first and second rollers. The first roller 30 and/or second roller 35 may be mounted on a rod 56 which is engaged to the first frame member 21 and the second frame member 22. There is an upper boss 26 secured to the first frame member 21 with one or more lugs 27 emanating out of the upper boss 26 and a boss handle 28 operationally associated with the upper boss 26 and passing through the first frame member 21, the boss handle 28 allowing for the raising and lowering of the upper boss 26 and a lower boss 24 secured to the second frame member 22 with one or more lugs 25 emanating out of the lower boss 24, where the upper boss 26 and lug 27 are designed to engage with the first end 13 of the core 12 of the film roll 10 by inserting the lug 27 into the notch 14 and the upper boss 26 into the first end 13 and where the lower boss 24 and lug 25 are designed to engage with the second end 15 of the core 12 of the film roll 10 by inserting the lug 25 into the notch 16 and the lower boss 24 into the second end 15. The first roller 30 further includes a tension adjustment handle 32 which allows a user to adjust the amount of tension applied to the stretch film 11 as it passes around the outer surface 36 of the first roller 30, between the first roller 30 and the second roller 35, and around the second roller 35 of the wrap dispenser 20 which is manually operated. The core 12 is comprised of metal, plastic, paper, cardstock, or a combination thereof and the notches 14, 16 have a shape selected from the group including, square, rectangular, circular, triangular, star, or a combination thereof. The core is a hollow tube, solid, or partially hollow. A portion or all of the upper 26 and lower boss 24 are inserted within the lumen 17 of the core 12 of the film roll 10 when the film roll is loaded into the wrap dispenser 20. The boss handle 28 is operationally associated with the upper boss 26 and passes through the first frame member 21 is spring loaded to compress and secure a film roll 10 between the upper boss 26 and lower boss 24.

Figure 16:
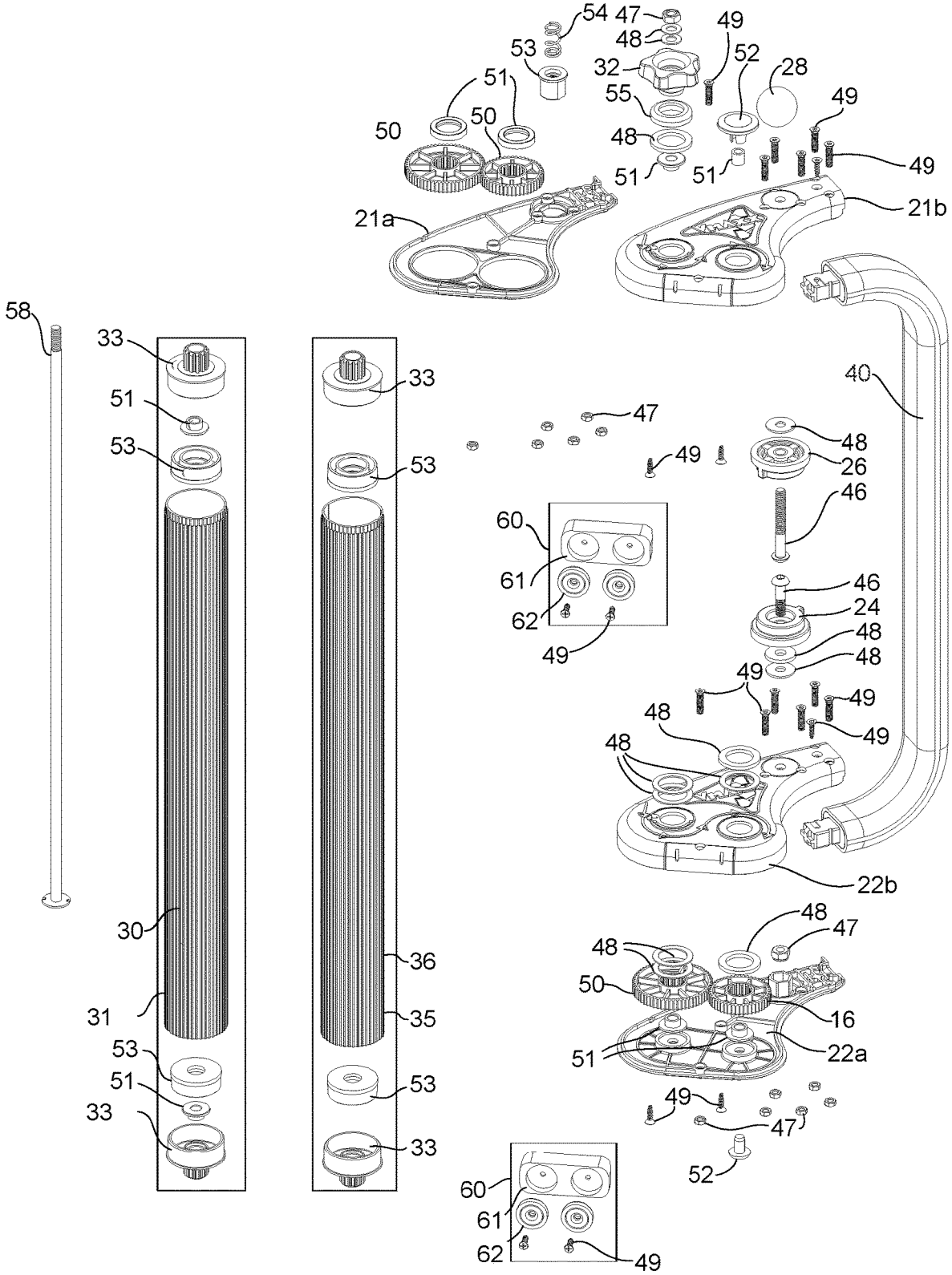
FIG. 16 is an exploded view of a dispenser.
Figure 17:
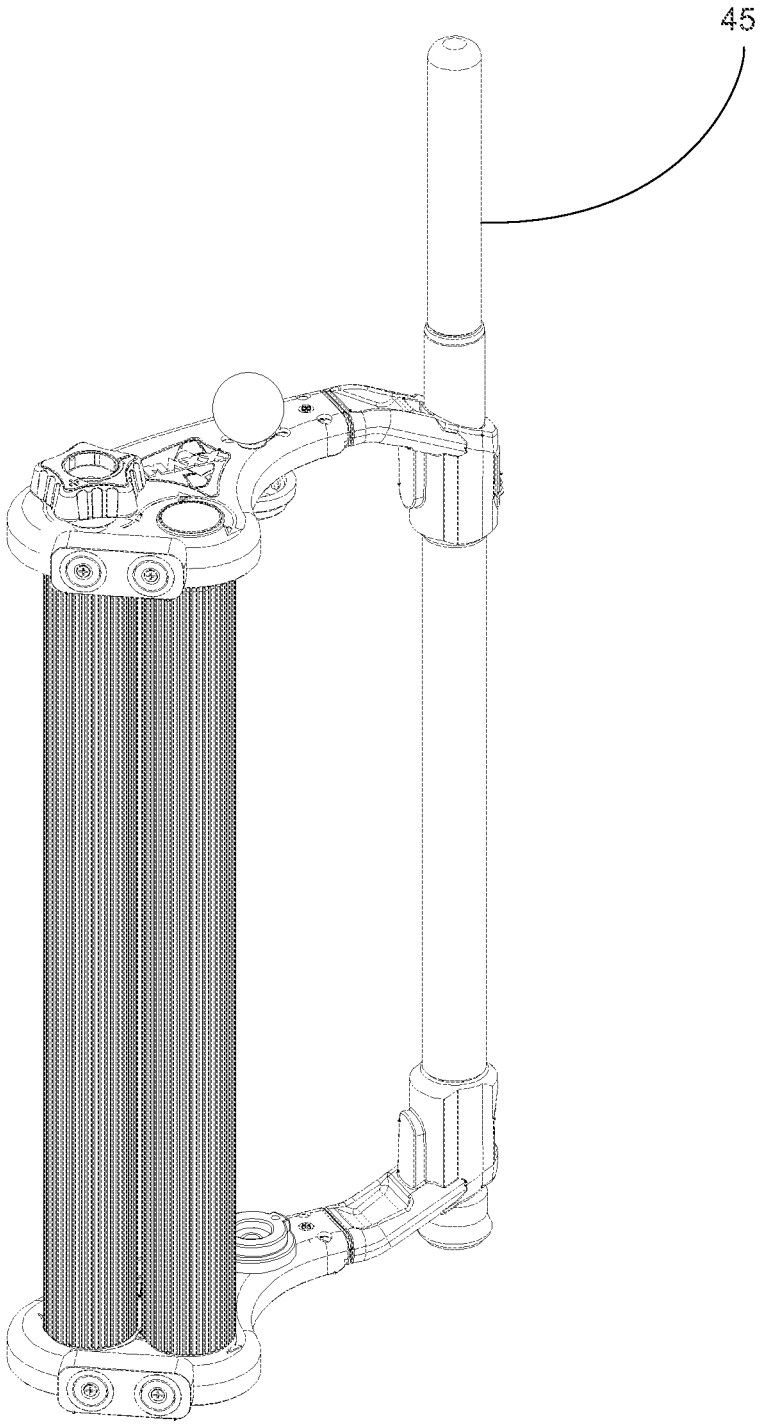
FIG. 17 is a proximal view of a dispenser.

Looking now to FIG. 16, there is shown an exploded view of a wrap dispenser of the instant invention which includes a first frame member 21 which includes a lower first frame member 21*a* and an upper first frame member 21*b* which encase a plurality of parts and are secured to one another using fasteners 49 (screws, bolts, rivets, etc.) and nuts 47. Also shown are a second frame member 22 which includes a lower second frame member 21*a* and an upper second frame member 21*b* which encase a plurality of parts and are secured to one another using fasteners 49 (screws, bolts, rivets, etc.) and nuts 47. A pair of roller assemblies are illustrated which include a roller 30, 35, a pair of bearings 53, a pair of bushings 51, and a pair of pinion caps 33. The first roller 30 is illustrated as having an outer surface 31, a bearing 53 engaged within each end of the first roller, a bushing 51 engaged to each bearing 53, and a pinion cap 33 engaged to each end. The second roller 35 is illustrated as having an outer surface 36, a bearing 53 engaged within each end of the second roller, a bushing 51 engaged to each bearing 53, and a pinion cap 33 engaged to each end. Each roller assembly may mounted on a rod 58 which travels through the second frame member 22, through the lumen of the roller, and through the first frame member 21 were is secured by a handle (such as the tension adjustment handle 32) and any other components necessary for proper functionality of the roller including bushings 51, bearings 53, springs 54, spacers 55, washers 48 (metal, plastic, wool felt, etc.) and covers 52. Each roller 30, 35 is rotatably engaged to the first frame member 21 and the second frame member 22, allowing them to rotate as stretch film 11 is dispensed using the wrap dispenser 20. Looking again to the Figures, we see a pair of gears 50 which are different sizes and have a different number of teeth secured between the lower first frame member 21*a* and the upper first frame member 21*b* and another pair of gears 50 which are different sizes and have a different number of teeth secured between the lower second frame member 22*a* and the upper second frame member 22*b*. A bushing 51 rests between each gear 50 and the upper first frame member 21*b* and the lower second frame member 22*a* and one or more washers 48 rest between each gear 50 and the lower first frame member 21*a* and the upper second frame member 22*b*. The pinion caps 33 located at each end of the rollers engage the gears encased with in the first frame member 21 and the second frame member 22 to facilitate the pre-stretching of the stretch film 11 as it is dispensed from the wrap dispenser 20. The tension adjustment handle 32 engages the rod 58 which travels through the second frame member 22, through the first roller, and through the first frame member where a variety of spacers, washers, bushings and bearings may be used to ensure proper function of the tension adjustment handle. A nut or similar device is then used to secure the rod 58 which also secures the tension adjustment handle 32. The lower boss 24 is rotatably secured using a bolt 46 which passes through the lower boss, one or more washers 48, the upper second frame member 22*b*, and then engages a nut 47. The upper boss 26 is rotatably secured using a bolt 46 which passes through the upper boss, one or more washers 48, the lower first frame member 21*a*, a bearing 53, a spring 54, and the upper first frame member 21*b*), where it engages the boss handle 28 which is threaded or contains an embedded nut 47.

The handle 40 is secured between the lower first frame member 21*a* and the upper first frame member 21*b* on one end and between the lower second frame member 22*a* and the upper second frame member 22*b* on its opposite end. Embodiments of the instant invention can also include a handle extension 45 which can be inserted into either end of the handle 40. The handle extension 45 allows for easier use for the user in allowing the user to raise the wrap dispenser 20 higher up with the handle extending from the bottom of the wrap dispenser 20 to wrap tall goods as well as to lower the wrap dispenser to the ground with the handle extending from the top of the wrap dispenser 20 to wrap goods at ground level. The handle extension 45 allows for one-handed or two-handed use by an individual using the device to wrap goods 39. Embodiments of the instant invention can also include one or more wheels, rollers, or roller bearings located on the lower second frame member 22*a* of the second frame member 22 to allow the wrap dispenser to roll on the ground as an individual uses the device to wrap goods 39 at ground level. Embodiments of the instant invention can also include one or more magnets 62 or magnet assemblies 60 to facilitate the easy storage of the wrap dispenser. The magnet assemblies include a magnet case 61 secured to the first frame member 21 or the second frame member 22 with one or more magnets 62 secured within the magnet case 61 and one or more fasteners 49 securing the magnets and the magnet case 61 to the frame member 21, 22.

The instant application also includes a method of wrapping goods comprising the steps of:

a) providing a film roll 10 that is compatible with a wrap dispenser 20 comprising:

a core 12 with a first end 13, a second end 15 an outer surface and a lumen 17;

the first end 13 having a notch 14 and the second end 15 having a notch 16;

a stretch film 11 wrapped around the outer surface 18 of the core 12;

b) providing a wrap dispenser 20 comprising:

a first frame member 21 and a second frame member 22;

a handle 40 connecting the first frame member 21 to the second frame member 22;

a first roller 30 connected to the first frame member 21 and the second frame member 22;

a second roller 35 connected to the first frame member 21 and the second frame member 22 and is operationally associated with the first roller 30;

an upper boss 26 secured to the first frame member 21 with one or more lugs 27 emanating out of the upper boss 26;

a boss handle 28 operationally associated with the upper boss 26 and passing through the first frame member 21, the boss handle 28 allowing for the raising and lowering of the upper boss 26; and a lower boss 24 secured to the second frame member 22 with one or more lugs 25 emanating out of the lower boss 24;

c) engaging the lower boss 24 and lug 25 with the second end 15 of the core 12 of the film roll 10 by inserting the lug 25 into the notch 16;

d) aligning the first end 13 of the core 12 of the film roll 10 with the upper boss 26;

e) engaging the first end 13 of the core 12 of the film roll 10 by inserting the lug 27 into the notch 14 of the first end;

f) feeding the stretch film 11 around the outer surface 31 of the first roller 30, between the first roller 30 and the second roller 35, and around the outer surface 36 of the second roller 35 of the wrap dispenser;

g) attaching the stretch film 11 to the goods which are to be wrapped;

h) wrapping the goods with the stretch film 11 by circling the goods one or more times to secure the goods in place; and i) cutting the stretch film 11.

The above method may further include the steps of providing the first roller 30 with a tension adjustment handle 32 which allows a user to adjust the amount of tension applied to the stretch film 11 as it passes between the first roller 30 and the second roller 35 of the wrap dispenser 20; and adjusting the tension applied to the stretch film 11 to the desired level.

The instant application also includes another method of wrapping goods comprising the steps of:

a) providing a film roll 10 that is compatible with a wrap dispenser 20 comprising:

a core 12 with a first end 13, a second end 15 an outer surface and a lumen 17;

the first end 13 having a notch 14 and the second end 15 having a notch 16;

a stretch film 11 wrapped around the outer surface of the core 12;

b) providing a wrap dispenser 20 comprising:

a first frame member 21 and a second frame member 22;

a handle 40 connecting the first frame member 21 to the second frame member 22;

a first roller 30 connected to the first frame member 21 and the second frame member 22;

a second roller 35 connected to the first frame member 21 and the second frame member 22 and is operationally associated with the first roller 30;

an upper boss 26 secured to the first frame member 21 with one or more lugs 27 emanating out of the upper boss 26;

a boss handle 28 operationally associated with the upper boss 26 and passing through the first frame member 21, the boss handle 28 allowing for the raising and lowering of the upper boss 26; and a lower boss 24 secured to the second frame member 22;

c) engaging the lower boss 24 with the second end 15 of the core 12 of the film roll 10 by inserting the lower boss 24 into the second end 15;

d) aligning the first end 13 of the core 12 of the film roll 10 with the upper boss 26;

e) engaging the first end 13 of the core 12 of the film roll 10 by inserting the lug 27 into the notch 14 of the first end;

f) feeding the stretch film 11 around the outer surface 31 of the first roller 30, then between the first roller 30 and the second roller 35 and around the outer surface 36 of the second roller 35;

g) attaching the stretch film 11 to the goods which are to be wrapped;

h) wrapping the goods with the stretch film 11 by circling the goods one or more times to secure the goods in place; and i) cutting the stretch film 11.

The above method may further include the steps of providing the first roller 30 with a tension adjustment handle 32 which allows a user to adjust the amount of tension applied to the stretch film 11 as it passes between the first roller 30 and the second roller 35 of the wrap dispenser 20; and adjusting the tension applied to the stretch film 11 to the desired level.

Any method described herein may incorporate any design element contained within this application and any other document/application incorporated by reference herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

The present invention may be embodied in other forms without departing from the spirit and the essential attributes thereof, and, accordingly, reference should be made to the appended claims, rather than to the foregoing specification, as indicating the scope of the invention. The invention illustratively disclosed herein suitably may be practiced in the absence of any element which is not specifically disclosed herein.

The invention claimed is:

1. A wrap dispenser comprising:

a first frame member and a second frame member;

a handle connecting the first frame member to the second frame member;

a first roller connected to the first frame member and the second frame member;

a second roller connected to the first frame member and the second frame member and is operationally associated with the first roller;

an upper boss with one or more lugs emanating out of the upper boss, rotatably secured to the first frame member using a bolt, the bolt passing vertically through the upper boss, through the first frame member, and through a coil spring where it engages a boss handle;

the boss handle operationally associated with the upper boss and allowing for the raising and lowering of the upper boss;

a lower boss rotatably secured to the second frame member with one or more lugs emanating out of the lower boss;

wherein the boss handle and upper boss are spring loaded to compress and secure a film roll between the upper boss and lower boss;

the film roll comprising a core with a first end, a second end, an outer surface, and a lumen;

the first end having a notch and the second end having a notch; and a stretch film wrapped around the outer surface of the core;

wherein the upper boss and lug are designed to engage with the first end of the core of the film roll by inserting the lug into the notch; and wherein the lower boss and lug are designed to engage with the second end of the core of the film roll by inserting the lug into the notch.

2. The film roll of claim 1 wherein the wrap dispenser is manually operated.

3. The film roll of claim 1 wherein the core is comprised of metal, plastic, paper, cardstock, or a combination thereof.

4. The film roll of claim 1 wherein the core is a hollow tube.

5. The film roll of claim 1 wherein the first roller further includes a tension adjustment handle which allows a user to adjust the amount of tension applied to the stretch film as it passes between the first roller and the second roller of the wrap dispenser.

6. The film roll of claim 1 wherein a portion or all of the upper and lower boss are inserted within the core of the film roll when loaded into the wrap dispenser.

7. The film roll of claim 1 wherein the first roller and the second roller include pre-stretch gears operationally associated with the first roller and the second roller which pre-stretches the stretch film as it is dispensed from the wrap dispenser.

8. The film roll of claim 7 wherein the pre-stretch gears pre-stretch the stretch film at an amount between 20% and 40%.

9. A method of wrapping goods comprising the steps of:

providing a wrap dispenser comprising:

a first frame member and a second frame member;

a handle connecting the first frame member to the second frame member;

a first roller connected to the first frame member and the second frame member;

a second roller connected to the first frame member and the second frame member and is operationally associated with the first roller;

an upper boss with one or more lugs emanating out of the upper boss, rotatably secured to the first frame member using a bolt, the bolt passing vertically through the upper boss, through the first frame member, and through a coil spring where it engages a boss handle;

the boss handle operationally associated with the upper boss and allowing for the raising and lowering of the upper boss;

a lower boss rotatably secured to the second frame member with one or more lugs emanating out of the lower boss;

wherein the boss handle and upper boss are spring loaded to compress and secure a film roll between the upper boss and lower boss;

providing the film roll that is compatible with a wrap dispenser comprising:

a core with a first end, a second end an outer surface and a lumen;

the first end having a notch and the second end having a notch;

a stretch film wrapped around the outer surface of the core;

pulling the upper boss upward using the spring biased boss handle;

engaging the lower boss and lug with the second end of the core of the film roll by inserting the lug into the notch;

aligning the first end of the core of the film roll with the upper boss;

engaging the first end of the core of the film roll by inserting the lug into the notch of the first end;

feeding the stretch film around the outer surface of the first roller, between the first roller and the second roller, and around the outer surface of the second roller of the wrap dispenser;

attaching the stretch film to the goods which are to be wrapped;

wrapping the goods with the stretch film by circling the goods one or more times to secure the goods in place; and cutting the stretch film.

10. The method of claim 9 wherein the wrap dispenser is manually operated.

11. The method of claim 9 wherein the core is comprised of metal, plastic, paper, cardstock, or a combination thereof.

12. The method of claim 9 wherein the core is a hollow tube.

13. The method of claim 9 further including the steps of:

providing the first roller with a tension adjustment handle which allows a user to adjust the amount of tension applied to the stretch film as it passes around the outer surface of the first roller, between the first roller and the second roller, and around the outer surface of the second roller of the wrap dispenser; and adjusting the tension applied to the stretch film to the desired level.

14. The method of claim 9 wherein a portion or all of the upper and lower boss are inserted within the core of the film roll when loaded into the wrap dispenser.

15. The method of claim 9 wherein the first roller includes pre-stretch gears operationally associated with the first roller and the second roller which pre-stretches the stretch film as it is dispensed from the wrap dispenser.

16. The method of claim 15 wherein the pre-stretch gears pre-stretch the stretch film at an amount between 20% and 40%.

* * * * *